United States Patent [19]

Johnson, Jr. et al.

[11] Patent Number: 4,829,747

[45] Date of Patent: May 16, 1989

[54] METHOD FOR OPENING AND INSERTING MULTI-CELL PARTITIONS

[75] Inventors: A. David Johnson, Jr., Wayne; George E. Ginther, Sr., King of Prussia; Joseph L. Bachman, Wayne, all of Pa.

[73] Assignee: Wayne Automation Corp., Norristown, Pa.

[21] Appl. No.: 45,518

[22] Filed: May 4, 1987

Related U.S. Application Data

[63] Continuation of Ser. No. 910,635, Sep. 23, 1986, abandoned.

[51] Int. Cl.[4] ..... B65B 43/30

[52] U.S. Cl. ..... 53/457; 493/91

[58] Field of Search ..... 53/452, 157, 246, 247, 53/564, 457, 566, 263, 157, 381 R; 493/90, 312, 91, 315, 391

[56] References Cited

U.S. PATENT DOCUMENTS 3,412,652 11/1968 McIntyre ..... 53/564 X
3,435,738 4/1969 Berney .
3,483,802 12/1969 Heyne ..... 493/91
3,621,765 11/1971 Sootheran et al. ..... 493/91
3,952,633 4/1976 Nakai ..... 493/91
4,435,941 3/1984 Booth et al. ..... 53/247 X

*Primary Examiner*—Horace M. Culver
*Attorney, Agent, or Firm*—Frederick J. Olsson

[57] ABSTRACT

Method contemplates: providing a set of collapsed multi-cell, crossed panel separator partitions arranged in upright position along a horizontal axis; applying vacuum grip to pull out the lead partition and move along the axis to a transfer station; relieving the pull-out vacuum grip and while supporting the partition in the upright position moving the same away from the transfer station along a second horizontal axis normal to the first axis to an opening station; applying vacuum grip to opposite sides of at least a single panel and rotating the panel to open the partition; and while the gripping force for opening is on the panel, moving the partition along a vertical axis down to an insert station and then removing the gripping force to thereby deposit the partition on the medium for which it is to serve its separating function.

12 Claims, 2 Drawing Sheets

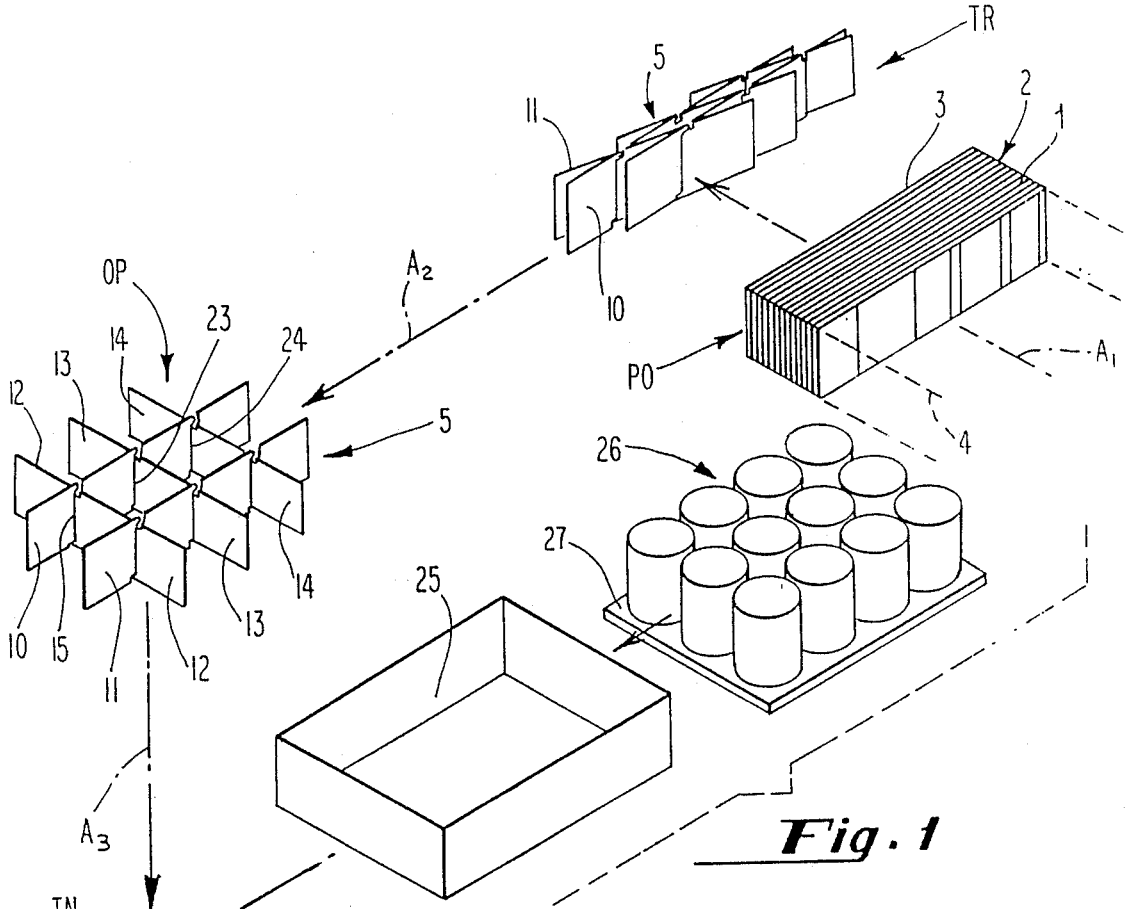
Fig. 1
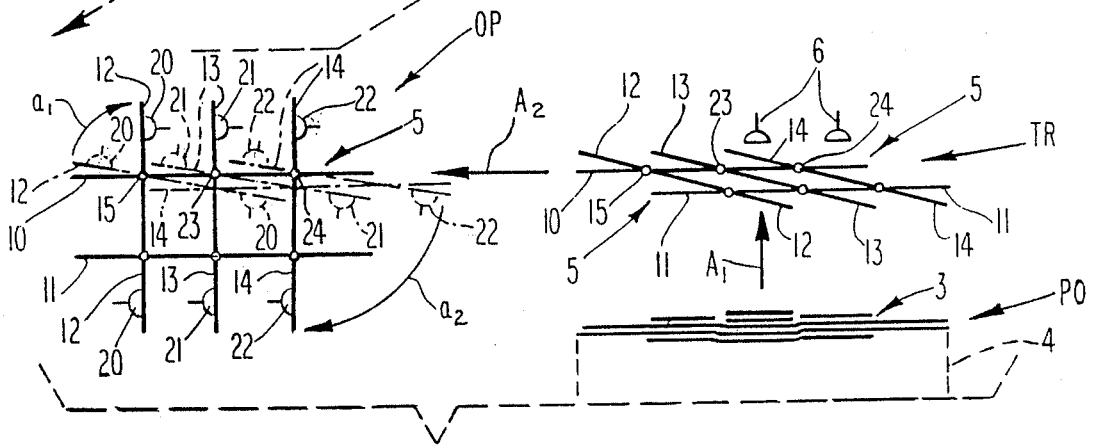
Fig. 2
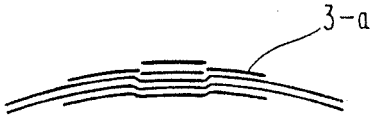
Fig. 2-A

METHOD FOR OPENING AND INSERTING MULTI-CELL PARTITIONS

The application is a continuation of application Ser. No. 910,635 filed 9/23/86.

The invention in general relates to the packaging arts and in particular relates to multi-cell separator partitions used in shipping cartons to isolate the articles being shipped.

More specifically, the invention relates to a method for taking collapsed, multi-cell partitions, opening the same, and depositing in the medium for which it will serve its separating function.

The principal object of the invention is to promote the useful arts of multi-cell partition opening and inserting by improved methods which have the following advantages: (1) being able to open collapsed partitions whether in planar or bowed condition; (2) imposing gripping forces on the partition so that the partition is always under firm, mechanical control: (a) while being removed from a set of collapsed partitions and positioned in a transfer station; (b) while being moved to a station for opening; (c) while being opened; and (d) while being moved to an insert station where it is deposited on the medium with which it is to serve.

The invention will be described below in connection with the following diagramatic views wherein:

FIG. 1 is perspective to illustrate the method for a typical partition from the state of being in collapsed condition to being opened and deposited;

FIG. 2 is plan view to further illustrate the method for opening the partition of FIG. 1;

Figure 3:
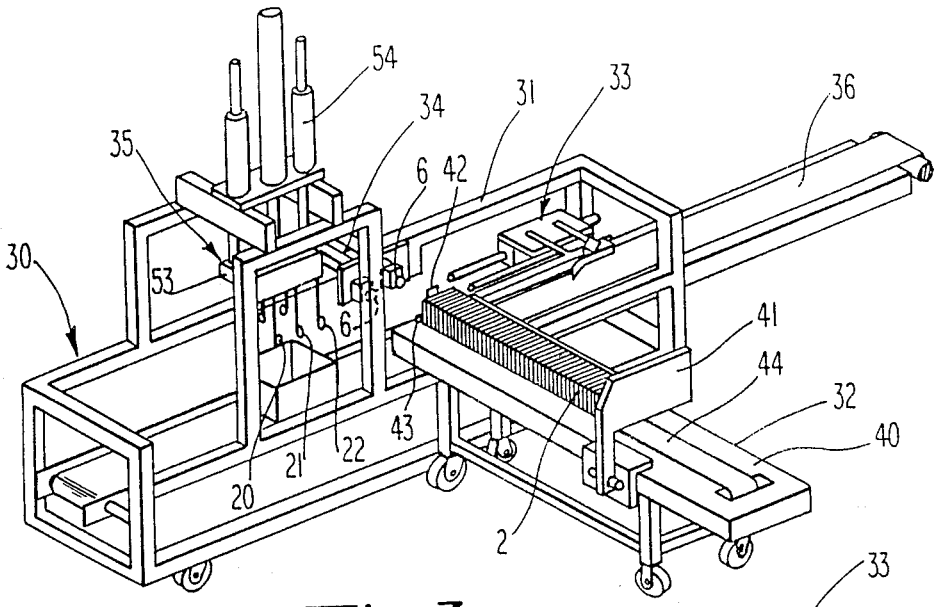
Figure 4:
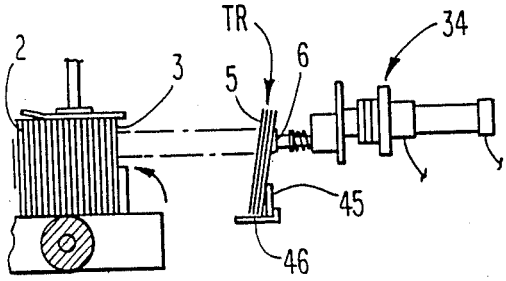
Figure 5:
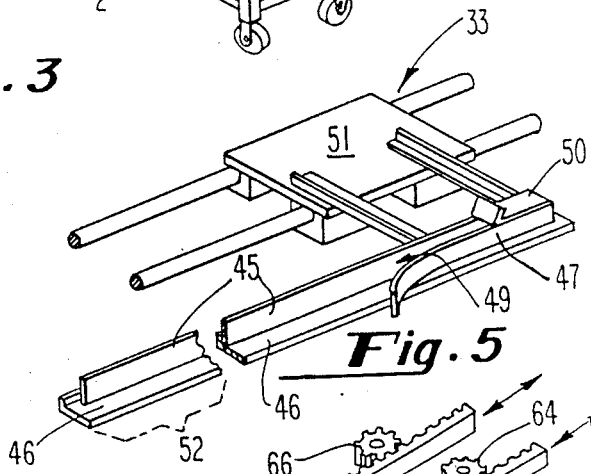
Figure 7:
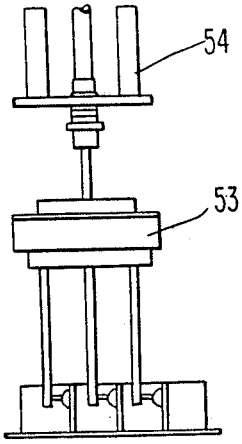
Figure 6:
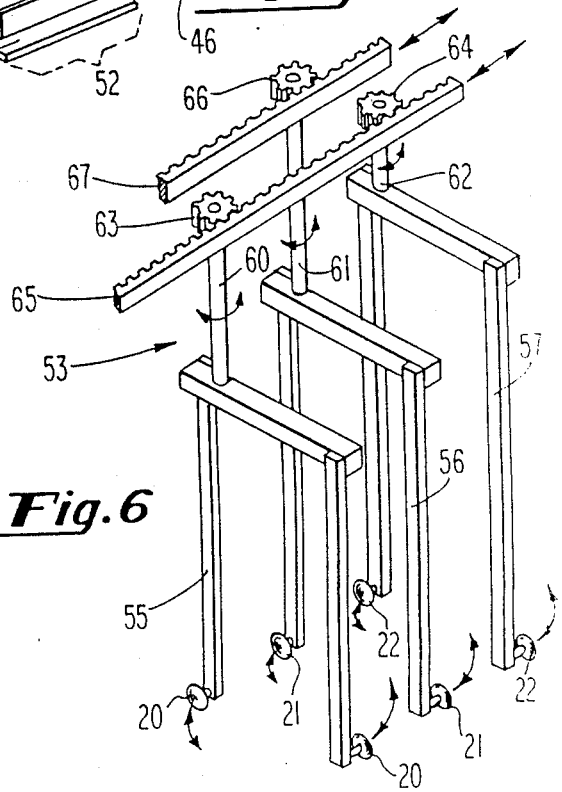

FIG. 2-A is a plan view of a bent partition;

FIG. 3 is a perspective of a typical machine arranged to carry out the steps of the method;

FIG. 4 is an elevational view of typical means used in the machine of FIG. 3 to pull out a lead partition from a magazine and set-up in a transfer station for transfer to an opening station;

FIG. 5 is a perspective view of a transporter used in the machine of FIG. 3 to take a partition from the transfer station to the opening station;

FIG. 6 is a perspective view of means used in the machine of FIG. 3 for opening a collapsed partition; and FIG. 7 is an elevational view of the opener means of FIG. 6 activated to move an opened partition to an insert station.

In FIG. 1 conventional, 12 -cell, collapsed partitions 1 are arranged in a set 2. The set extends along a horizontal axis $A_1$. The partitions are oriented in upright position. The lead partition 3 is in a pull-out station P. The set is contained in a magazine 4. The magazine permits the lead partition to be pulled out while in upright, collapsed condition and for shifting the set along the axis $A_1$ as the lead partition is removed so that the next following partition moves into the pull-out station.

When a lead partition is pulled out, it is moved in upright position along the axis $A_1$ away from the set 2 to a transfer station TR as is shown for the partition 5. The pull-out force is developed by a pair of vacuum cups 6 (FIG. 2) which are adapted to reciprocate between the transfer station and the pull-out station. Note that in FIG. 2, the partition is shown as somewhat open; this done so that the several panels can be identified.

Next, the partition 5 is picked up, gripped, and moved away from the transfer station TR along another horizontal axis $A_2$ (normal to axis $A_1$) to an opening station OP where it is gripped by the opening means and opened as indicated.

The partition 5 is conventional in form having parallel panels 10 and 11 and crossed parallel panels 12, 13, and 14 with the intersection points between crossed panels provided by interleaved slots.

After the partition is opened and with the opening means still gripping the panels, the partition is moved down along the vertical axis $A_3$ to an insert station IN. The gripping force is removed so that the partition is then deposited on the medium for which it is to serve its separating function.

In setting up the partition in the transfer station, a selected panel, say the panel 10, (referred to as a datum panel) is positioned in that it contains the axis $A_2$. The datum panel and axis $A_2$ relationship remains as the partition is moved from the transfer station to the opening station OP.

The reason for the relationship between axis $A_2$ and the datum panel 10 is that in the opening process, gripping forces are applied to the opposite side of at least one crossed panel, for example, the panel 12 (referred to as a pivot panel) and the pivot panel 12 rotated about the intersection 15 with the datum panel 10. Since all of the panels are linked at the various intersections, the rotation of panel 12 causes the other panels 11, 13, and 14 to also move and cause the partition to open or assumes the position shown by the full lines in FIGS. 1 and 2.

The opening mechanism (discussed later) employs a vacuum cup means to generate the gripping forces on the partition. With reference to FIG. 2, the collapsed partition 5 (shown in dotted lines) is in the opening station OP and a pair of vacuum cups indicated by dotted lines 20 respectively grip opposite sides of the pivot panel 12. The cups 20 are simultaneously moved clockwise indicated by arrows $a_1$ and $a_2$ along respective arcuate paths to rotate the panel 12 90° about the intersection 15.

For control purposes, the other crossed panels 13 and 14 are also gripped and simultaneously rotated along with the panel 12. This is done by the pairs of vacuum cups 21 and 22.

The cups 21 are disposed on opposite sides of panel 13 and rotate the same 90° about intersection 23. The pair 22 are disposed on opposite sides of panel 14 and rotates the same 90° about the intersection 24.

In the fully open position, the vacuum cups 20, 21, and 22 remain engaged with the respective panels as shown by the full lines so that the opened partition is now ready to be moved to the insert station IN. For this purpose, the vacuum cups 20, 21, and 22 are moved down along the vertical axis $A_3$ and carry the partition to the insert station IN.

At the insert station the vacuum grip of the cups 20, 21, and 22 is relieved and the cups moved vertically upward to the opening station OP. Thus, the partition is deposited in the medium with which it is to perform its separating function.

The medium with which the partition is used may be any shipping or packaging arrangement needing a separator. The medium may be, for example, a shipping carton 25 or a set of glass jars 26 on a base 27. Prior to the time the opened partition is moved into the insert station, the station has been set up with the medium to receive the partition. Thus, the cartons or jars are brought up along axis $A_4$ one by one into the insert station by a intermittently operated conveyer belt. After receiving the partition, the conveyer moves the medium to another work station for the packaging operation.

Certain other steps with are preferably employed in the method can best be explained in connection with a description of typical equipment for practicing the method which will be done in connection with FIGS. 3 through 7.

Referring to FIG. 3, the machine 30 has a main frame 31 and dolly 32 removably connected to the frame 31. The dolly 32 carries the magazine 4 while the frame 31 carries a transporter 33, pull-out means 34, opener/inserter means 35, and conveyor 36.

The magazine has a top plate 40 mounting the set of partitions 2. The set is confined between a pressure plate 41 and the gate 42/ stops 43 and rests on a conveyor belt 44. The gate 42 defines the pull-out station PO. The pressure plate 41, gate 42, and conveyor belt 44 have drive mechanism not shown and are controlled so that the gate is rotated away from the lead carton so the same can be pulled out (skipping past the stops 43) and then rotated back to the up position so that the pressure plate and conveyor can be stepped forward to compress the set against the gate and position the succeeding partition in the pick-off station.

The pull-out means 23 includes a cylinder mounting a reciprocating piston which carries the vacuum cups 6. As shown, the cups 6 are in the transfer station TR and are adapted to move between the transfer station TR and the pull-out station PO.

The transporter 33 has a partition line-up wall 45 and a coextensive partition support foot 46. A bent arm 47 cooperates with the wall 45 and foot 40 to form a partition receiving cavity 49. The rear of the cavity is defined by stop 50. The foregoing elements are mounted on a reciprocating trolley 51.

In FIG. 5 the transporter 5 is in the ready condition. The forward sections of the wall 45 and leg 46 indicated at 52 are disposed below the pull-out cups 6 in the transfer station TR ready to receive a partition pulled out by the cups. After a partition is one the forward section 52, the transporter moves from the ready position to the left so that the partition is picked up by the cavity 49 and the transporter then moves so that the cavity 49 brings the partition into the opening station OP. The transporter then moves back to the ready position.

Certain details of the pull-out of the lead partition, its transfer to the transfer station TR, and its transfer to the opening station OP will be further described in connection with FIG. 4.

One principal function of the line-up wall 45 is to position the partition so that when the partition is received in the cavity 49, the datum panel 10 contains the axis $A_2$. The term "contains", of course, is used in the sense that the datum panel attains a fixed relationship with the axis $A_2$. The axis $A_2$ may be within the panel or parallel the same.

The forward section 52 of the transporter and the cup are set up so that when the partition is moved out of the transfer station TR, the partition does not wipe against the cups. This insures against damage to cups, and/or partition. This feature is accomplished as follows.

When the pull-out cups have pulled the partition to the transfer station TR, the partition is slightly tilted in a direction away from the set 2. The bottom part of the partition is held by the wall 45 while the top part is held by the cups 6. The condition is attained by that when the cups are in the transfer station TR, they are located slightly away from the axis $A_2$.

When the transporter has moved to place the partition in the cavity 49, the cavity slides over the bottom of the partition. The space between wall 45 and leg 47 is such that the wall and leg tend to cause the partition to become upright (against the form of the cups 6). Just when the stop 51 engages the partition, the vacuum of cups 6 is relieved and the partitions snap away from the cups as it begins to move the same toward the opening station OP.

The method may be employed whether partitions, when taken out of the shipping cartons or off shipping skids, are in ideal condition (planar) or in non-ideal condition (bent). One bent condition is illustrated in FIG. 2-A for the partition 3-a. To accomodate the bent condition, the invention contemplates moving the vacuum cups 6 so that the lead partition is pushed back into the set. This action tends to cause the partition to assume a planar form so that cups will be able to grip a flat surface to develop a vacuum. Partitions may be bent in a direction opposite to that shown in FIG. 2-A.

In arranging for the above action of cups 6, it is preferred to spring mount the same on their respective pistons. This will avoid damage to partitions and/or cups in the event the set is comprised of planar partitions which can cause the set to set up substantial resistance to cup motion.

The opener/inserter means includes cup support and rotating mechanism 53 diagramatically illustrated in (FIG. 6) and the reciprocating drive 54 for the cup support/rotating mechanism 53.

Referring to FIG. 6, the pairs of vacuum cups 20, 21, and 22 are respectively supported on U-shaped brackets 55, 56, and 57 each having a drive shaft 60, 61, and 62. The shafts 60 and 62 have pinion 63 and 64 moved by racks 65 and the shaft 61 has pinion 66 moved by rack 67. The racks 65 and 67 are moved linearly, simultaneously and this moves the pairs of cups 20, 21, and 22 over the 90° axis to grip the panels of the partition and open same as previously described. The drive mechanism for the racks 65 and 67 takes conventional form.

The reciprocating drive 54 is comprised for a conventional piston cylinder arrangement which can reciprocate the cup support/ rotating mechanism 53 from the opening station OP of FIG. 1 down to the insert station IN as noted in FIG. 7 to deposit a partition.

The various drive means and timing controls for causing the machine to operate in the sequence described are of conventional form. So too are the pneumatic device and controls for the various suction cups.

While we have described the method in connection with a 12-cell partition, it will be understood that the method may be employed for partitions having a larger or smaller number of cells.

We claim:

1. The method of opening a collapsed, multi-cell, crossed-panel separator partition and inserting the open partition on the medium for which it is to perform its separating function, comprising the steps of:

providing a set of collapsed, multi-cell, crossed-panel partitions in substantially upright position with the set extending along a first horizontal axis and with the lead partition in a pull-out station;

developing a first vacuum gripping force on the lead partition and pulling the partition out of the pull-out station and moving the same along said first horizontal axis while in said upright position to a transfer station and causing a first panel of the partition to substantially contain a second horizontal axis normal to said first horizontal axis and causing the partition to tilt in a direction slightly away from set;

relieving said first vacuum gripping force and causing said partition to assume said upright position and moving the partition away from the transfer station along said second horizontal axis while in said upright position and with said one panel substantially containing said second horizontal axis to an opening station;

while in said opening station, exerting second vacuum gripping force on one side of a second panel crossed with said first panel and exerting third vacuum gripping force on the opposite side of said second panel, and while maintaining said first panel in said second axis, moving the second and third gripping forces along arcuate paths respectively in opposite directions away from said second axis to rotate the second panel and effect opening of said partition; and while in said open condition and said second and third vacuum gripping forces are intact, moving the opened partition vertically downward along a vertical axis normal to said second horizontal axis to an insert station and then relieving said second and third gripping forces to thereby deposit the open partition on the medium for which it is to serve its separating function.

2. The method of opening a collapsed, multi-cell, crossed-panel separator partition and inserting the open partition on the medium for which it is to perform its separating function, comprising the steps of:

providing a set of collapsed, multi-cell, crossed-panel partitions in substantially upright position with the set extending along a first horizontal axis and with the lead partition in a pull-out station;

developing a first vacuum gripping force on the lead partition and pulling the partition out of the pull-out station and moving the same along said first horizontal axis while in said upright position to a transfer station and causing a first panel of the partition to substantially contain a second horizontal axis normal to said first horizontal axis;

relieving said first vacuum gripping force and moving the partition away from the transfer station along said second horizontal axis while in said upright position and with said one panel substantially containing said second horizontal axis to an opening station;

while in said opening station, exerting second vacuum gripping force on one side of a second panel crossed with said first panel and exerting third vacuum gripping force on the opposite side of said second panel, and while maintaining said first panel in said second axis, moving the second and third gripping forces along arcuate paths respectively in opposite directions away from said second axis to rotate the second panel and effect opening of said partition; and while in said open condition and said second and third vacuum gripping forces are intact, moving the opened partition vertically downward along a vertical axis normal to said second horizontal axis to an insert station and then relieving said second and third gripping forces to thereby deposit the open partition on the medium for which it is to serve its separating function.

3. The method of claim 1 and 2 wherein the first vacuum gripping force developed on the lead partition operates, prior to pulling out the same, to first push the lead partition into said set along said first axis in a direction opposite to the direction of movement for said pull-out to thereby insure the creation of gripping force on a bent lead partition.

4. The method of opening a collapsed, multi-cell, crossed-panel separator partition having a plurality of parallel panels and inserting the open partition on the medium for which it is to perform its separating function, comprising the steps of:

providing a set of collapsed, multi-cell, crossed-panel partitions with each partition having a plurality of parallel panels and with the lead partition in a pull-out station;

moving the lead partition out of the pull-out station to an opening station;

while said lead partition is in said opening station, exerting, on at least two of said parallel panels, vacuum gripping forces respectively on the same side of each said panel and moving the gripping forces respectively along arcuate paths to rotate each said panel and effect opening of said partition; and while at said opening station and in said open condition and with said vacuum gripping forces intact, causing relative motion along an axis between the opened partition and an insert station having the medium for which the partition is to serve its separating function to insert the open partition on the medium and thereafter relieving said vacuum gripping forces.

5. The method of opening a collapsed, multi-cell, crossed-panel separator partition having a plurality of parallel panels and inserting the open partition on the medium for which it is to perform its separating function, comprising the steps of:

providing a set of collapsed, multi-cell, crossed-panel partitions with each partition having a plurality of parallel panels and with the lead partition in a pull-out station;

moving the lead partition out of the pull-out station to an opening station;

while said lead partition is in said opening station, exerting, on at least two of said parallel panels, vacuum gripping forces respectively on opposite sides of each said panel and moving the opposite gripping forces along arcuate paths respectively in opposite directions to rotate each said panel and effect opening of said partition; and while at said opening station and in said open condition and with said vacuum gripping forces intact, causing relative motion along an axis between the opened partition and an insert station having the medium for which the partition is to serve its separating function to insert the open partition on the medium and thereafter relieving said vacuum gripping forces.

6. In a method of opening a collapsed, multi-cell, crossed-panel separator partition having a plurality of parallel panels and inserting the open partition on the medium for which it is to perform its separating function, the steps of:

providing a collapsed, multi-cell, crossed-panel partition, the partition having a plurality of parallel panels and providing the medium on which the open partition is to be inserted;

exerting, on at least two of said parallel panels, vacuum gripping forces respectively on the same side of each said panel and moving the gripping forces respectively along arcuate paths to rotate each said panel and effect opening of said partition; and while in said open condition and with said vacuum gripping forces intact, causing relative motion along an axis between the opened partition and an insert station and said medium to insert the open partition of the medium and thereafter relieving said vacuum gripping forces.

7. For a set of collapsed, multi-cell, cross-panel partitions the set extending along an axis and with a lead partition in a pull-out station in a bent condition, the method of pulling the lead partition out of the pull-out station comprising the steps of:

using a plurality of vacuum cups, engaging the lead partition and pushing the same into the set in a direction along said axis to insure the creation of gripping forces by each said vacuum cups on respective panels of the bent lead partition and thereafter reversing the direction of motion and pulling the lead partition out of the pull-out station.

8. For use in a method of opening a collapsed, multi-cell, crossed-panel separator partition having at least two parallel panels and inserting the open partition on the medium for which it is to perform its separating function:

piston and cylinder means, the cylinder mounting the piston for reciprocating motion along a vertical axis; and vacuum cup support and rotating mechanism disposed below and connected with said piston for reciprocating motion therewith, the cup support and rotating mechanism comprising:

(a) at least two vertically extending parallel, spaced-apart shafts arranged for simultaneous rotation about the respective vertical axes, the axes of the shafts being coplanar;

(b) a set of at least two vertically extending arms respectively connected to said shafts for rotation therewith and each arm being radially spaced from its shaft;

(c) a set of at least two vacuum cups respectively connected to the lower ends of said arms for rotation and for vertical motion therewith, the cups facing in the same direction and being for use in respectively gripping said two parallel panels, the gripping being on the same side of the gripped panels and said rotation of the cups effecting said opening of the partition and said vertical motion of the cups in a downward direction effecting said inserting of the open partition on said medium.

9. For use in a method of opening a collapsed, multi-cell, crossed-panel separator partition having at least two parallel panels and inserting the open partition on the medium for which it is to perform its separating function:

piston and cylinder means, the cylinder means mounting the piston means for reciprocating motion along a vertical axis; and vacuum cup support and rotating mechanism disposed below and connected with said piston means for reciprocating motion therewith, with cup support and rotating mechanism comprising:

(a) at least two vertically extending parallel, spaced-apart shafts arranged for simultaneous rotation about the respective vertical axes, the axes of the shafts being coplanar;

(b) a set of at least two vacuum cups respectively connected to said shafts for rotation and vertical motion therewith, the cups facing in the same direction and being for use in respectively gripping and parallel panels, the gripping being on the same side of the gripped panels and said rotation of the cups effecting said opening of the partition and said vertical motion of the cups in a downward direction effecting said inserting of the open partition on said medium.

10. For use in a method of opening a collapsed, multi-cell, crossed-panel separator partition having at least two parallel panels and inserting the open partition on the medium for which it is to perform its separating function;

piston and cylinder means, the cylinder mounting the piston for reciprocating motion along a vertical axis; and vacuum cup support and rotating mechanism disposed below and connected with said piston for reciprocating motion therewith, the cup support and rotating mechanism comprising:

(a) at least two vertically extending parallel, spaced-apart shafts arranged for simultaneous rotation about the respective vertical axis, the axes of the shafts being coplanar;

(b) a set of at least two vertically extending arms respectively connected to said shafts for rotation therewith and each arm being radially spaced from its axis;

(c) a plurality of sets of vacuum cups, the cups in each set respectively connected to the lower ends of said arms for rotation and vertical motion therewith, the cups facing in opposite directions and the cups of each set being for use in respectively gripping the opposite sides of one of said parallel panels;

said rotation of the cups effecting said opening of a partition and said vertical motion of the cups in a downward direction effecting said inserting of the open partition in said medium.

11. The method of:

providing a set of collapsed, multi-cell crossed-panel partitions, the set extending along an axis with a bent lead partition in a pull-out station;

moving a plurality of vacuum cups toward the bent lead partition until at least one of the vacuum cups reaches said pull-out station and engages a panel of the bent lead partition;

continuing to move the vacuum cups until each of the other vacuum cups have respectively engaged panels of the bent lead partition so that the vacuum cups push the lead partition back into the set to insure the creation of gripping forces by each of said vacuum cups on panels of the lead partition; and thereafter reversing the direction of motion and pulling the lead partition out of the pull-out station.

12. The method of:

providing a set of collapsed, multi-cell crossed-panel partitions, the set extending along an axis with a bent lead partition in a pull-out station;

moving vacuum cups means toward the bent lead partition until the vacuum cup means reaches said pull-out station and engages a panel of the bent lead partition;

continuing to move the vacuum cup means so that it pushes the lead partition back into the set to an extent to insure the creation of gripping forces on panels of the lead partition; and thereafter reversing the diretion of motion and pulling the lead partition out of the pull-out station.

* * * * *

US004829747B1

REEXAMINATION CERTIFICATE (1854th)

United States Patent [19]

[11] B1 4,829,747

Johnson, Jr. et al.

[45] Certificate Issued Nov. 24, 1992

[54] METHOD FOR OPENING AND INSERTING MULTI-CELL PARTITIONS

[75] Inventors: A. David Johnson, Jr., Wayne; George E. Ginther, Sr., King of Prussia; Joseph L. Bachman, Wayne, all of Pa.

[73] Assignee: Wayne Automation Corp.

Reexamination Request:
No. 90/002,267, Feb. 1, 1991

Reexamination Certificate for:

| | |
|---|---|
| Patent No.: | 4,829,747 |
| Issued: | May 16, 1989 |
| Appl. No.: | 45,518 |
| Filed: | May 4, 1987 |

Related U.S. Application Data

[63] Continuation of Ser. No. 910,635, Sep. 23, 1986, abandoned.

[51] Int. Cl.[5] ..... B65B 43/30; B65H 3/08

[52] U.S. Cl. ..... 53/497; 493/91; 271/102; 271/161

[58] Field of Search ..... 53/452, 157, 246, 247, 53/564, 457, 566, 263, 386.1, 381.6, 381.1; 493/90, 91, 312, 391, 123, 313, 316; 271/102, 105, 106, 107, 161

[56] References Cited

U.S. PATENT DOCUMENTS

| | | | |
|---|---|---|---|
| 1,129,456 | 2/1915 | Conradi | 271/102 |
| 2,357,535 | 9/1944 | Monroe . | |
| 3,008,385 | 11/1961 | Pierce, Jr. . | |
| 3,242,827 | 3/1966 | Winters . | |
| 3,257,002 | 6/1966 | Pearson . | |
| 3,412,652 | 11/1968 | Berney . | |
| 3,483,802 | 12/1969 | Heyne | 493/91 |
| 3,534,667 | 10/1970 | Krause . | |
| 3,552,280 | 1/1971 | Jaroch . | |
| 3,621,765 | 11/1971 | Sootheran et al. | 493/91 |
| 3,633,470 | 1/1972 | Bingham . | |
| 3,691,715 | 9/1972 | Kelly . | |
| 3,747,294 | 7/1973 | Calvert . | |
| 3,803,993 | 4/1974 | Graham . | |
| 3,952,633 | 4/1976 | Nakai | 493/91 |
| 4,086,746 | 5/1978 | Christy | 53/386.1 X |
| 4,435,941 | 3/1984 | Booth et al. | 53/247 X |
| 4,921,237 | 5/1990 | Nubson et al. | 271/161 X |

FOREIGN PATENT DOCUMENTS

| | | |
|---|---|---|
| 975233 | 3/1949 | Fed. Rep. of Germany . |
| 2356319 | 5/1975 | Fed. Rep. of Germany . |

OTHER PUBLICATIONS

Model V-100 Automatic Partition Inserter, Clevepak Machinery Division, White Plains, N.Y.
Transnova Packing Machines, Transnova GmbH.

*Primary Examiner*—Horace M. Culver

[57] ABSTRACT

Method contemplates: providing a set of collapsed multi-cell, crossed panel separator partitions arranged in upright position along a horizontal axis; applying vacuum grip to pull out the lead partition and move along the axis to a transfer station; relieving the pull-out vacuum grip and while supporting the partition in the upright position moving the same away from the transfer station along a second horizontal axis normal to the first axis to an opening station; applying vacuum grip to opposite sides of at least a single panel and rotating the panel to open the partition; and while the gripping force for opening is on the panel, moving the partition along a vertical axis down to an insert station and then removing the gripping force to thereby deposit the partition on the medium for which it is to serve its separating function.

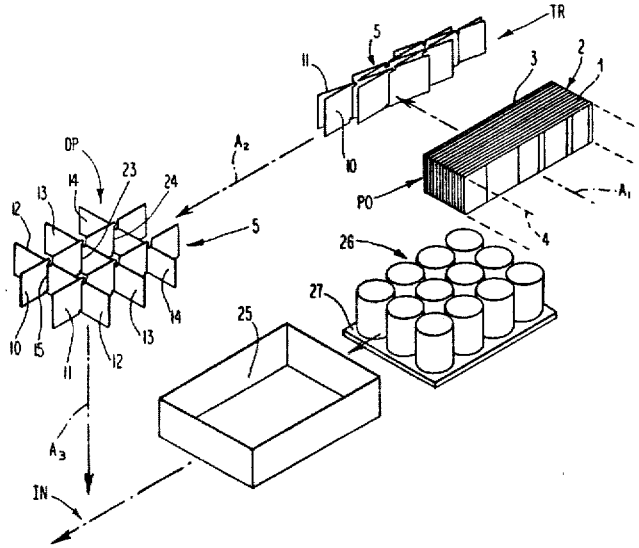

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1–6 and 8–10 is confirmed.

Claims 7, 11 and 12 are cancelled.

* * * * *